United States Patent [19]

Sauerland

[11] 4,197,676

[45] Apr. 15, 1980

[54] APPARATUS FOR AUTOMATIC LAPPING CONTROL

[76] Inventor: Franz L. Sauerland, 2851 Southington Rd., Shaker Heights, Ohio 44120

[21] Appl. No.: 924,884

[22] Filed: Jul. 17, 1978

[51] Int. Cl.[2] ..... B24B 49/04

[52] U.S. Cl. ..... 51/165 R; 51/118; 318/607

[58] Field of Search ..... 318/607, 653; 51/165 R, 51/283, 118

[56] References Cited

U.S. PATENT DOCUMENTS

| | | | |
|---|---|---|---|
| 2,340,843 | 2/1944 | Bailey | 51/283 R |
| 3,063,206 | 11/1962 | Meyerhoff | 51/165 R |
| 3,097,458 | 7/1963 | Richmond | 51/165 R X |
| 3,579,922 | 5/1971 | Mandonas | 51/165 R |

*Primary Examiner*—Harold D. Whitehead

[57] ABSTRACT

Apparatus for automatic lapping control, based on imbedding an electrode of special construction in a lapping plate of a lapping machine, including at least one piezoelectric wafer in the lapping load, sensing the resonance frequency of the piezoelectric wafers as they pass by the electrode, and automatically terminating the lapping when the resonance frequency equals or exceeds a target frequency; the special electrode construction comprising a facing of a dielectric material with a high dielectric constant and surrounded by an insulator having a low dielectric constant and an average wall thickness larger than its wall thickness at the surface of the lapping plate.

8 Claims, 7 Drawing Figures

APPARATUS FOR AUTOMATIC LAPPING CONTROL

BACKGROUND OF THE INVENTION

The invention relates to apparatus for controlling the lapping and polishing of plan parallel wafers to close thickness tolerance. More specifically it relates to apparatus for reliable and accurate automatic lapping control and to improvements of conventional lapping control apparatus. One major application is the lapping and polishing of piezoelectric materials such as ceramic or quartz crystal wafers intended for frequency control applications and requiring precise thickness control. Another application is lapping and polishing of nonpiezoelectric materials.

There are various types of conventional machines used for lapping flat wafers. Two examples are the planetary lap and the excentric or pin lap. In both machines the wafers are positioned between two lapping plates and moved with respect to the latter by means of socalled carriers. These are made of sheets of material thinner than the wafers and contain cutouts for the wafers. A lapping slurry, usually consisting of a water or oil based suspension of grinding powder, such as carborundum or aluminum oxide, is fed between the lapping plates and serves to grind and flush away the wafer particles. For polishing, a finer powder is used, and the plates may be covered by a buffeting surface. In another type of lapping machine, the wafers are again located between two plates but fixed in position—for example by waxing—to the surface of one plate. The two plates are moved relative to each other, and a slurry is fed between them. The wafers are lapped one side at a time.

The planetary lapping machine is explained in more detail below in conjunction with the description of the invention.

The main conventional methods for controlling the lapping process are described below and referred to as Methods 1 through 5.

Method 1 is based on an empirical relationship between lapping speed and lapping time. Lapping is terminated after a specified time at a constant speed.

Method 2 is based on monitoring the wafer thickness by means of measuring the distance between the lapping plates. This distance can be related to the width of an air gap between two surfaces that are referenced to the two respective lapping surfaces. The gap can be measured by various means such as air gauges or capacitive measurements.

Method 3 is based on mechanical stops that serve to limit the thickness of the lapping load from decreasing below a preset value. One approach is to use spacers between the lapping plates made from hard material such as diamond. Another approach uses the carriers such as the spacers.

Methods 1, 2, 3 are simple but relatively inaccurate. In Method 1 the accuracy can be improved by repeated unloading, measuring, reloading and relapping of the wafers. In Methods 2 and 3 the thickness is controllable to a tolerance of about ±0.005 mm, which is insufficient for precision applications such as the lapping of thin quartz wafers. An advantage of Methods 1, 2 and 3 is that they can be easily automated.

Methods 4 and 5 are used for lapping wafers consisting of piezoelectric material. They are based on the piezoelectric effect which causes a piezoelectric wafer to vibrate mechanically when exposed to an a. c. signal, and to emit an a. c. signal when exposed to mechanical vibrations. In a lapping machine the mechanical vibrations are exerted on the wafer by the grinding action of slurry and lapping plates, and the corresponding a. c. signals appear between the lapping plates. The frequency of these signals corresponds to the resonance frequencies of the wafers and is therefore related to their dimensions. For example, in flat AT cut quartz wafers the resonance frequency is related to the thickness by approximately $$f = 1.66 \times 10^6 / T \quad (1)$$

where f is measured in Hz and T is the wafer thickness in mm. Hence during lapping the wafer frequency increases inversely proportional to T. For example, at a frequency of 32.2 MHz, the wafer thickness is 0.05 mm according to (1). Lapping the polishing of flat AT cut quartz wafers is routinely done up to about 35 MHz and is feasible to above 60 MHz. Desired thickness control is on the order of ±0.1%, which for the above example corresponds to a thickness tolerance of ±0.00005 mm.

In Method 4 a radio receiver or similar frequency selective sensor is connected to the lapping plates to monitor the signals emitted by the wafers as they are being lapped. Normally the resonance frequencies of the individual wafers are different from each other and extend over a frequency "spread" between the lowest and highest wafer frequencies. The signals can be indicated audibly by the receiver's loudspeaker as a spectrum of increased noise as the receiver is tuned through the spread. An operator can monitor the signals and turn off the lapping machine when the spread reaches a predetermined relation to a target frequency. The main limitation of this method is due to the fact that the signals are very weak, are shunted by the large capacitance between the lapping plates, and become progressively buried in electrical noise toward higher frequencies such that the upper practical frequency limits are about 15 MHz in planetary laps and 25 MHz in pin laps. The electrical noise originates from sources external and internal to the lapping machine. The lapping plate acts as an antenna for external signals such as radio transmissions and signals caused by neighboring electrical lines or apparatus. Most environmental signals could be shielded by means such as a Faraday cage, but this method is rarely used because it is cumbersome in practice and because of the additional noise internal to the machine. A major source for internal noise are metallic carriers, which are used in most planetary laps. The noise is due to electrical short circuits between the lapping plates by means of the carriers. At higher wafer frequencies these carriers are quite thin and will warp or buckle between the plates because of the lateral stresses exerted on them during lapping. This causes short circuits between the plates which are usually intermittent because of the randomly isolating effect of the slurry granules.

Automatic lapping control based on Method 4 is available but suffers from the described noise problem and is therefore rarely used at frequencies above a few MHz.

Method 5 is based on the injection of an electrical signal into at least one electrode imbedded in at least one of the lapping plates. If the frequency of the injected signal equals the resonance frequency of a wafer passing under an electrode, the impedance under the electrode shows a characteristic change which can be displayed by instrumentation such as an oscilloscope to indicate the occurrence of wafer resonance. An operator can monitor the wafer frequencies and terminate the lapping when they reach a predetermined relation to a target frequency. This method can be made less sensitive to external electrical noise than Method 4. However, it requires more expensive instrumentation and has other drawbacks which limit its usefulness and make it unsuitable for reliable automatic lapping control. This is explained in more detail in conjunction with the description of the invention.

SUMMARY OF THE INVENTION

Presently there appears to be no conventional method or equipment in existence or known for reliable and precise automatically controlled lapping of piezoelectric and especially quartz wafers over the fundamental AT frequency spectrum, which extends over more than 30 MHz. Present nonautomatic equipment has various disadvantages such as inaccuracy or high labor content or both. Also, there appears to be no method or equipment for reliable and precise automatically controlled lapping of nonpiezoelectric wafers.

A major objective of the invention is to provide apparatus for precise and reliable automatic control of lapping piezoelectric wafers up to at least 30 MHz. Another objective is to improve the performance of conventional apparatus for lapping piezoelectric wafers. A third objective is to provide apparatus for precise and reliable automatic control of lapping nonpiezoelectric wafers.

The present invention overcomes the problems and satisfies the objectives mentioned above. It is based on imbedding at least one electrode of special construction in at least one lapping plate of a lapping machine, including at least one piezoelectric wafer in the lapping load, monitoring the electrical signals and the corresponding resonance frequencies of the piezoelectric wafers as they pass by the electrode, and automatically terminating the lapping when the response frequency equals or exceeds a target frequency.

BRIEF DESCRIPTION OF THE DRAWINGS

For a better understanding of the invention, reference is made to the following description taken in conjunction with the accompanying drawings, and its scope is pointed out in the appended claims.

DESCRIPTION OF PREFERRED EMBODIMENTS

The invention is explained by first elaborating on the background of the invention as it relates to the previously mentioned Method 5. This method has some features in common with one embodiment of the invention. It also has a number of drawbacks which are explained to illustrate characteristics and advantages of the present invention.

Figure 1:
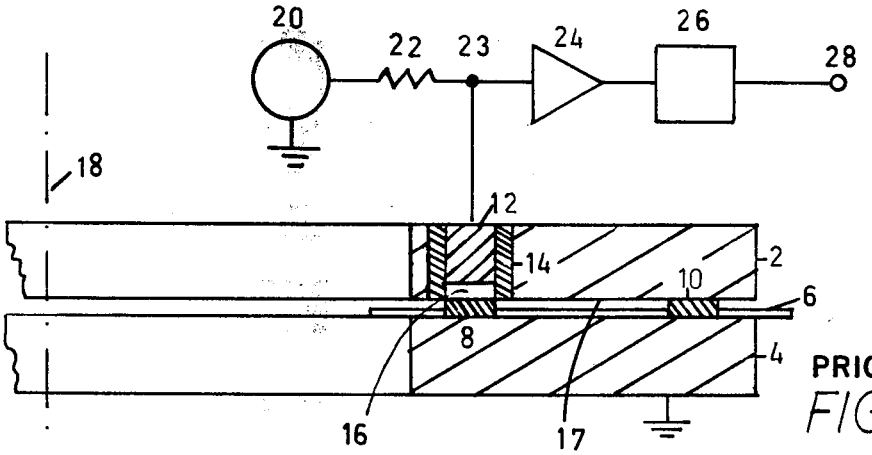
PRIOR ART FIG. 1
FIG. 1 is a partial and simplified vertical cross section of a planetary lapping machine with an imbedded electrode in the upper lapping plate and a simplified block diagram of electrical circuitry used for sensing impedance changes under the electrode.

FIG. 1 shows a partial and simplified vertical cross section of a planetary lapping machine with an upper lapping plate 2, a lower lapping plate 4, a carrier 6, two wafers 8 and 10, an electrode 12, an insulator 14, a gap 16, a lapping surface 17, and a lapping plate center axis 18. The lower lapping plate is connected to ground. Not shown is the lapping slurry, which fills the gaps between the lapping plates and covers the wafer surfaces. Also included in FIG. 1 is a simplified diagram of the circuitry used for sensing the impedance changes under the electrode 12. It comprises a grounded radio frequency (r.f.) sweep generator 20 whose output is applied to a resistor 22 in series with electrode 12. The junction 23 between resistor 22 and electrode 12 is connected to the input of an amplifier 24 whose output is applied to a radio frequency detector 26 with an output 28.

Figure 2:
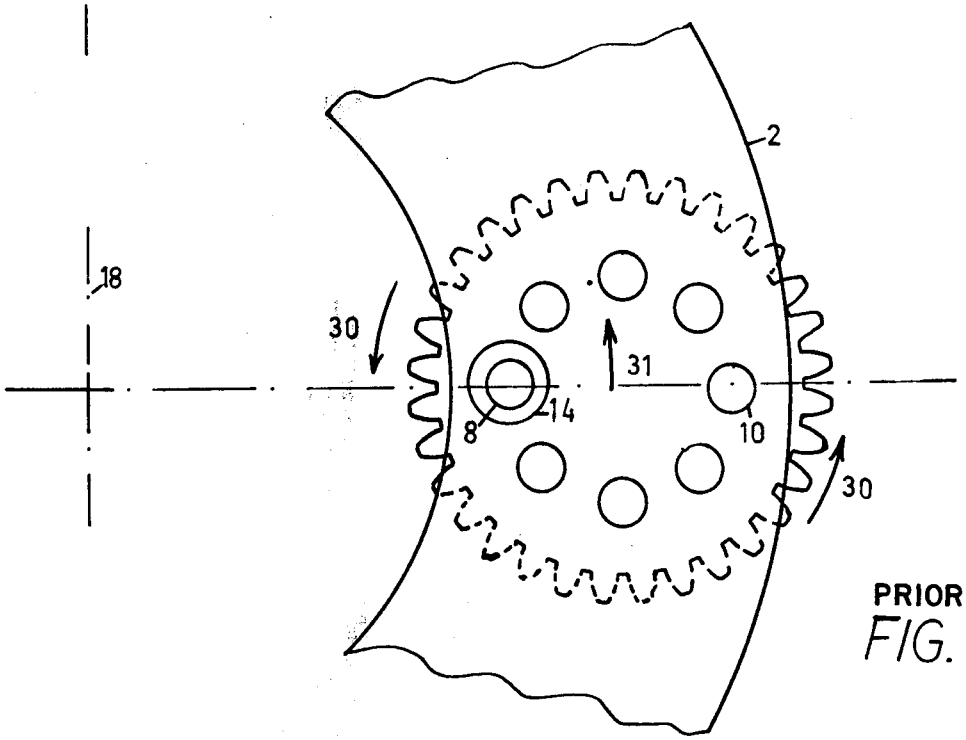
PRIOR ART FIG. 2
FIG. 2 is a partial top view corresponding to the cross section of FIG. 1.

FIG. 2 presents a partial top view corresponding to the arrangement of FIG. 1. It shows part of the upper lapping plate 2, center axis 18, carrier 6, wafers 8 and 10, and six more unmarked wafers. The carrier teeth engage in gears which are not shown and are concentrically arranged along the outer and inner periphery of the lapping plates, driving the carriers as indicated by arrows 30 and 31 in planetary movement around their own axis and around axis 18, respectively.

Method 5 is based on the impedance characteristic of a piezoelectric wafer. In the vicinity of the wafer's resonance frequency, the wafer impedance as measured between two metallic surfaces is approximately analogous to the impedance of an electrical series resonant circuit comprising a series connection of an inductance L, a capacitance C, and a resistance R. At series resonance, the wafer impedance attains a minimum value equal to the resistance R.

During the lapping operation, impedance changes under the electrode 12 produce changes in the signal at junction 23. If a wafer passes under the electrode and if its resonance frequency coincides with the frequency of generator 20, the impedance under the electrode goes through a minimum value equal to R. The corresponding change in r.f. signal at junction 23 is amplified in amplifier 24 and detected in detector 26 such that the resonance impedance variation is indicated by a signal level variation at detector output28.

Generally the lapping plates, carriers and electrodes are metallic. In the conventional method the gap 16 is filled with slurry, and the width of the gap is of critical importance. If it is too narrow, the electrode can be intermittently shorted to ground because of the previously mentioned carrier buckling. If it is too large, then the sensitivity of the impedance change sensing is reduced to the point where the desired signals are swamped by error signals. Hence the air gap must be carefully adjusted and readjusted as the lapping plates and wafers wear down and as the lapping conditions are changed. This approach is cumbersome but feasible as long as the impedance changes and the desired and undesired signals under the electrode can be monitored and distinguished, such as by visual inspection of an oscilloscope. The approach is not used and not practical for automatic control.

Figure 3:
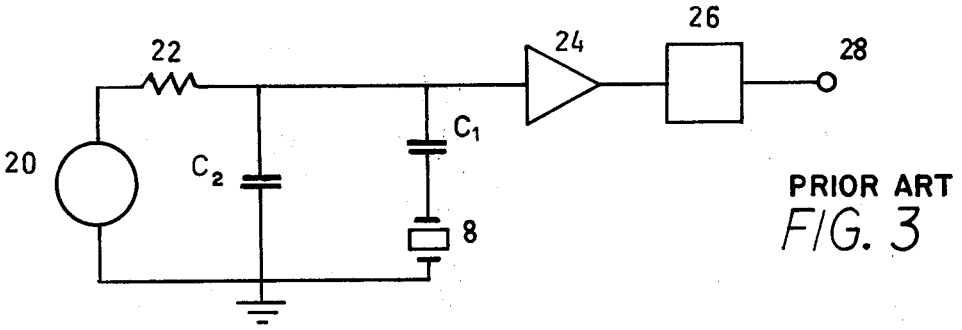
PRIOR ART FIG. 3
FIG. 3 is an elaborated diagram of the electrical circuitry of FIG. 1.

The situation can be further explained by analyzing the electrical circuit of FIG. 1, which is redrawn and elaborated in FIG. 3. Here the wafer 8 is represented by the electrical symbol for a piezoelectric resonator, and the electrical effect of the gap 16 is indicated by a capacitance $C_1$. $C_2$ represents the capacitance between the electrode and the upper lapping plate, which upper lapping plate at high frequencies can be considered shorted to the lower lapping plate and ground by the relatively large capacitance between the lapping plates.

At the wafer's series resonance frequency, the wafer impedance is minimum and equal to R. If no wafer and no carrier is under the electrode, R is replaced by a capacitance that in the following is called $C_3$. For the sensing of the wafer resonances the relative size of the resistance R and the reactances of $C_1$, $C_2$ and $C_3$ are of decisive importance. This is demonstrated below by way of a numerical example.

The capacitances $C_1$, $C_2$ and $C_3$ can be evaluated by the approximate general formula for a capacitance between 2 parallel electrodes separated by a dielectric medium, $$\text{Capacitance (in picofarad)} = 0.009\ KA/s \qquad (2)$$

where K is the relative dielectric constant of the dielectric medium, A the electrode area in $mm^2$ and s the electrode separation in mm. The equation for the wafer's resonance resistance is approximately $$R = 0.17 \times 10^{10}/f^2 d^2 Q \qquad (3)$$

where f is the wafer resonance frequency in MHz, d the wafer diameter in mm and Q the effective quality factor of the wafer measured in its lapping environment. Due to the mechanical loading of the wafer by the slurry and the weight of the lapping plate, Q is lower than the wafer's inherent quality factor.

The relative size of the wafer resistance and the reactances of $C_1$, $C_2$ and $C_3$ can be assessed by way of a practical example. Referring to FIG. 1, let the electrode 12 and the wafer 8 both have a diameter of 6 mm, the insulator 14 have an outer diameter of 8 mm, the gap 16 have a width of 0.6 mm and the lapping plate 2 have a thickness of 12 mm. Further, let the relative dielectric constant of the insulator and lapping slurry be 4 and 2, respectively, and let Q of equation (3) be 600. The corresponding resistance and reactance values are listed below for various lapping frequencies.

| f/MHz | 4 | 10 | 20 | 40 |
|---|---|---|---|---|
| R/Kilo Ohm | 5 | .8 | .2 | .05 |
| Reactance of $C_1$/Kilo Ohm | 55 | 23 | 11 | 5.5 |
| Reactance of $C_2$/Kilo Ohm | 4 | 1.7 | .9 | .4 |
| Reactance of $C_3$/Kilo Ohm | 32 | 5.3 | 1.3 | .32 |

By inspection of this list or by mathematical network analysis it becomes apparent that in this example the reactances of $C_2$ and especially of $C_1$ severely swamp the signal changes across the electrode that are due to the wafer resonances. As a result, the signal/noise ratio is reduced to a point where it becomes difficult to distinguish between desired and undesired signals. This and the need for frequent readjustment of the gap are two of the major reasons why Method 5 is unsuitable for reliable automatic lapping control. Another disadvantage due to $C_1$ and $C_2$ is the need for a signal source with a relatively high power in order to provide a given voltage across the wafer.

This concludes the review of the prior art. In the system according to the invention, $C_2$ is reduced by suitable choice of geometry and insulation, and $C_1$ is increased by using an electrode having a layer of solid dielectric insulating material facing and extending to the lapping surface. While most insulating materials have a relative dielectric constant smaller than 8, the electrode layer preferably has a high relative dielectric constant such as larger than 10. The thickness of the layer is preferably larger than the amount of wear expected during part or all of the useful lifetime of the lapping plate.

Referring first to increasing $C_1$, one example of a suitable dielectric material is ceramic Barium Titanate, which may have a relative dielectric constant on the order of 12,000. With this material the reactance of $C_1$ can be made very small while at the same time the width of the dielectric layer can be increased to accommodate wear of both the lapping plate and the electrode. In the above example, the reactance of $C_1$ at 20 MHz would be reduced from 11,000 Ohm to 1.8 Ohm. Even increasing the thickness of the dielectric from 0.7 mm to 5 mm—a typical lifetime wear of a lapping plate—would still represent a reactance of less than 7% of the wafer's resonance resistance. Hence the effect of $C_1$ on the signal/noise ratio becomes insignificant. Furthermore, error signals due to short circuits by buckling carriers do not show up and are either insignificant or nonexistent. A likely explanation is that because of the slurry interface and the carrier warping the short circuits are due to intermittant point contacts rather than surface contacts. Since the electrode surface is nonconducting, a point contact cannot cause any significant impedance reduction under the electrode because the contact surface and the corresponding series capacitance is small.

Referring now to reducing $C_2$, this could be achieved by increasing the wall thickness of the insulator 14 in FIG. 1. However, this would require a larger area in the lapping surface that differs in hardness and wear from the surface of the lapping plates, thereby making the lapping surface more prone to become nonflat during lapping. A preferred way for reducing $C_2$ is to choose an insulating material with a low relative dielectric constant and to make the average insulator wall thickness between electrode and lapping plate larger than the insulator thickness at the lapping surface. This can be further explained by considering FIG. 4, which illustrates one embodiment of the invention. It shows a partial and simplified cross section of a planetary lapping machine analogous to that of FIG. 1, with like parts marked by like reference numerals with a prime (′). In addition to the analogous parts it comprises: an insulator 52; an electrode with a solid dielectric disk 54, an upper conducting surface 56, and a conducting rod or wire 58 connected to the surface 56. Also included in FIG. 4 is a block diagram of electrical control circuitry comprising: a voltage controlled oscillator 60 whose output is connected to a resistor 62 in series with the electrode; an automatic control circuit 64 described in more detail below and having two input terminals 86 and 87, an output terminal 90 and a sweep voltage terminal 88; a solid state relay 66 connected in series with a lapping machine motor 68 and a power line outlet 69, and controlled by output 90 of control circuit 64.

Figure 4:
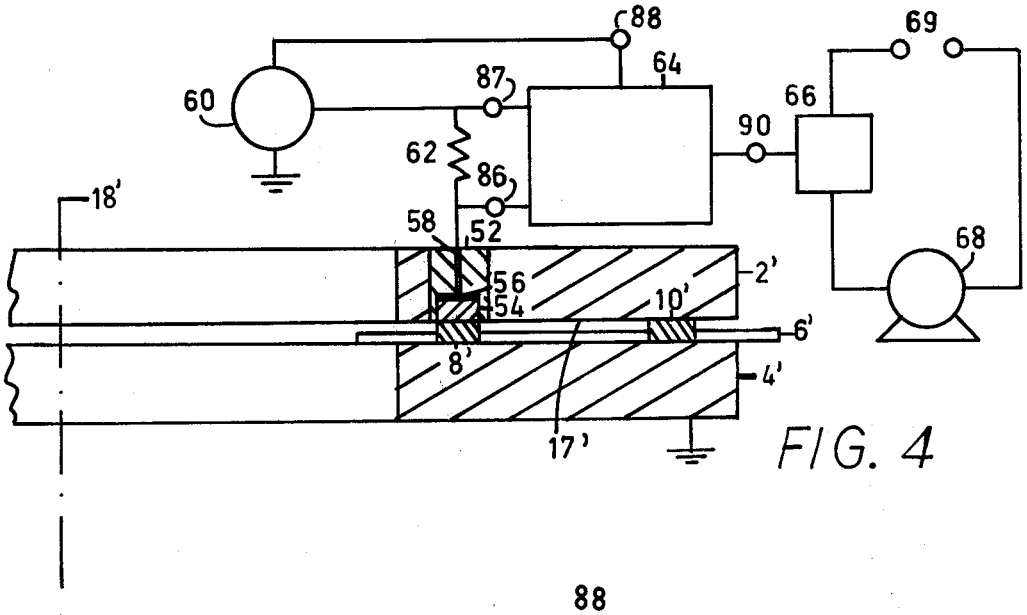
FIG. 4 is a partial and simplified vertical cross section of a planetary lapping machine with an electrode arrangement according to the present invention and a block diagram of circuitry for automatic lapping control, based on the injection of a signal into the electrode.

As can be seen from FIG. 4, the average insulator thickness between the electrode and lapping plate taken over the thickness of the lapping plate is larger than the insulator thickness at the lapping surface. This is achieved by reducing the electrode cross section away from the lapping surface. It could also be achieved with an electrode of constant cross section and an insulator with increased cross section away from the lapping surface.

The purpose of automatic lapping control is to terminate lapping when the frequency of one or more piezoelectric monitor wafers in the lapping load reaches a defined relationship with a target frequency. One definition of this relationship would be to terminate lapping as soon as a wafer frequency reaches or exceeds the target frequency. Another definition would be to terminate lapping when the upper frequency of the "spread" as defined before exceeds the target frequency by a predetermined fraction of the spread.

Figure 5:
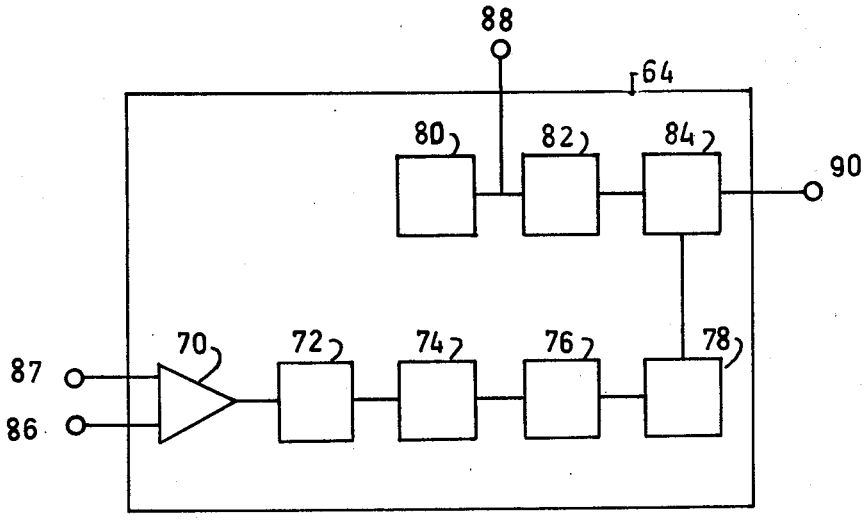
FIG. 5 is a block diagram of the automatic lapping control circuitry of FIG. 4.

FIG. 5 shows an example of a block diagram corresponding to the automatic control circuit 64 of FIG. 4. The control circuit block 64 is shown with its terminals 86, 87, 88 and 90 for interconnection with the circuit of FIG. 4. Inside block 64, the circuit comprises: a differential amplifier 70 whose input terminals are connected to terminals 86 and 87 and whose output is applied to a cascade connection of an r.f. detector 72, filter 74, level shifter 76 and peak detector 78; a sweep voltage generator 80 whose output is applied to terminal 88 and to a squaring circuit 82; a coincidence detector 84 whose two inputs are connected to the outputs of peak detector 78 and squaring circuit 82 and whose output is applied to terminal 90.

The circuit can operate as follows. The sweep generator 80 has a triangular output wave form symmetric to a reference voltage level $V_r$. The sweep voltage is converted by circuit 82 into a square wave whose crossings of the $V_r$ level are coincident with those of the sweep voltage crossings. The reference voltage $V_r$ is adjusted such that the corresponding frequency of the Voltage Controlled Oscillator 60 of FIG. 4 equals a desired target frequency. The frequency of the Voltage Controlled Oscillator is then swept about this target frequency. When a wafer resonance frequency falls within the swept frequency range, the corresponding impedance change under the electrode causes a voltage change across resistor 62 which is amplified, detected and filtered in blocks 70, 72 and 74. The signal at the output of filter 74 shows a strong amplitude change with a maximum at the wafer resonance. To separate this response from any undesired noise, the signal is applied to level shifter 76 which shifts the reference level above the noise level. The output of level shifter 76 is applied to peak detector 78, which detects the exact location of the maximum or peak of a change in its input voltage and provides an output voltage coincident with the input voltage peak, which as explained before occurs at the wafer resonance frequency. The coincidence detector 84 serves to monitor the outputs of peak detector 78 and squaring circuit 82 and is adjusted such that it produces an output signal that turns off solid state relay 66 only when peaks coincide with sweep voltages equal to or larger than the reference voltage $V_r$. This means that lapping is terminated as soon as an observed wafer frequency reaches or exceeds the target frequency.

If only one electrode is used, the wafer frequencies are observed sequentially during lapping, and it may take a relatively long time to observe all wafers. Since all wafer frequencies are changing continuously during lapping, it is usually desirable to reduce the observation time. This can be achieved by various means. For example, in a planetary lapping machine the spread among the wafers in one carrier is generally small compared with the spread over the whole lapping load, and lapping control can be sufficiently accurate if only one wafer per carrier is observed. Another means for reducing the observation time is by using several electrodes in the lapping plate and connecting them in parallel. While the system according to the invention has been explained in its application to planetary laps, it is also applicable to pin laps. In those cases where pin laps are operated with nonconducting carriers, the electrode need not be faced with a dielectric material, but is preferably designed such that the shunt capacitance $C_2$ of FIG. 4 is reduced or minimized. For example, an electrode configuration like that shown in FIG. 5 would be suitable except that part 64 can be a conductive rather than dielectric material.

A similar consideration holds for polishing applications. For polishing, the lapping surfaces are frequently covered with a nonconducting buffeting surface which electrically acts similar to an air gap between electrode and wafer. In this case, the electrode face may again be metallic, but $C_2$ of FIG. 5 is preferably reduced or minimized.

The system according to the invention can also be applied to automatic control of lapping nonpiezoelectric wafers. In this case, at least one piezoelectric monitor wafer is included in the lapping load. Its frequency can be related to the thickness of the lapping load by a predictable relationship such as equation (1). Lapping is terminated when the monitor frequency reaches a predetermined target frequency.

Figure 6:
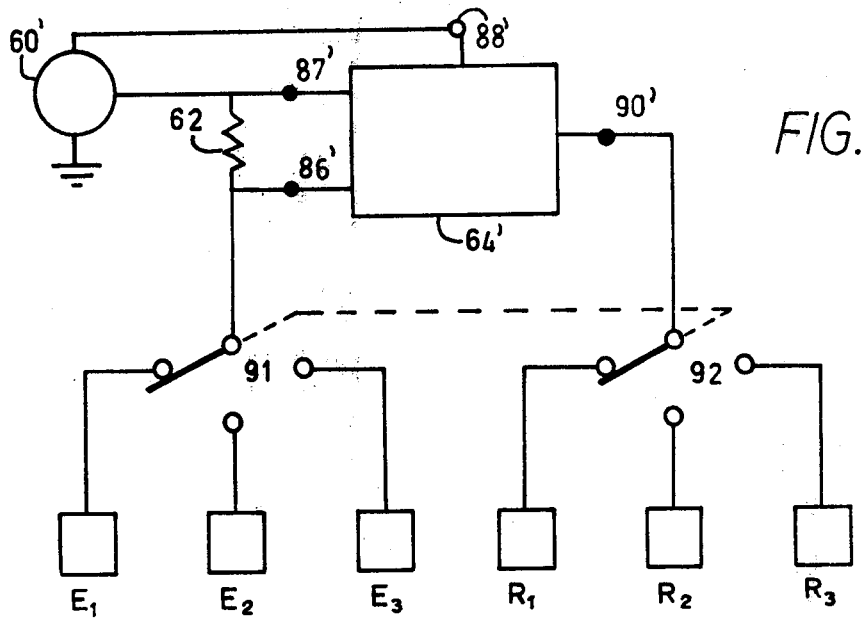
FIG. 6 is a block diagram of an automatic lapping control circuit connected to control several lapping machines.

An alternate embodiment of the invention is the multiplexing of one set of control instrumentation with several lapping machines. An example for three lapping machines is shown in FIG. 6. Part of the circuitry in this figure is analogous to that of FIG. 4, with like parts shown by reference numerals with a prime (′). Terminals 86′ and 90′ are connected to the wipers of two ganged single pole switches 91 and 92, respectively. Switch 91 is connected to electrodes $E_1$, $E_2$ and $E_3$ of three lapping machines (not shown), and switch 92 is connected to solid state relays $R_1$, $R_2$ and $R_3$ controlling the motors of said lapping machines. Sequential switching of switches 91 and 92 between the 3 positions provides sequential control of the three lapping machines.

Figure 7:
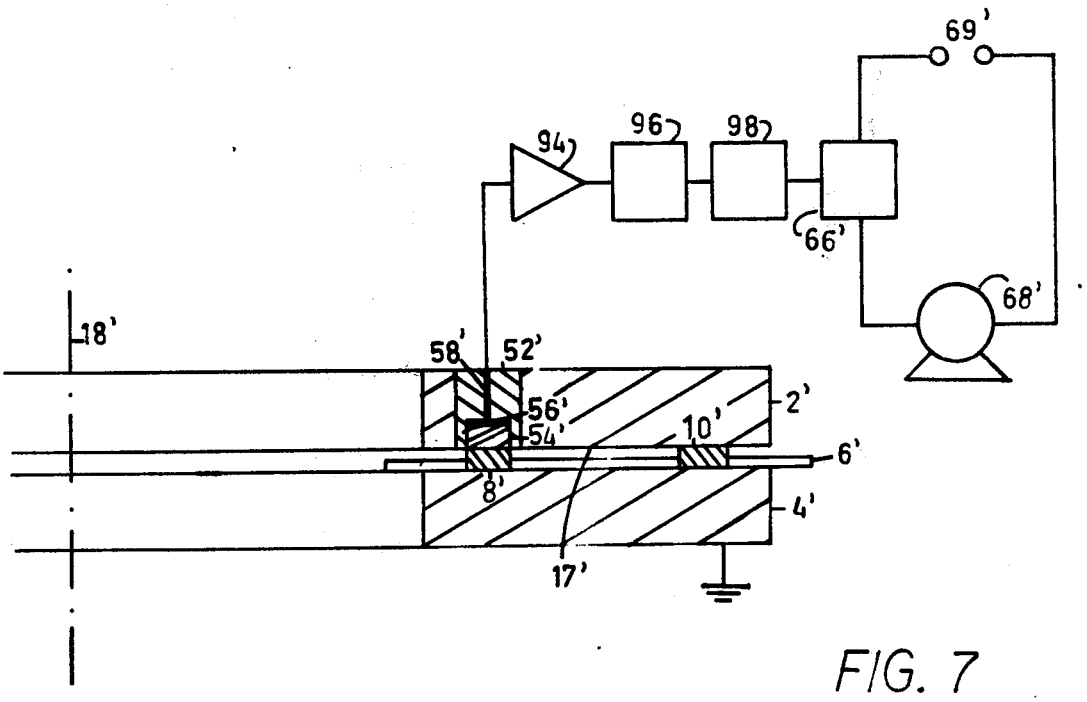
FIG. 7 is a partial and simplified vertical cross section of a planetary lapping machine with an electrode arrangement according to the present invention and a block diagram of circuitry for automatic lapping control, based on the reception of a signal from the electrode.

The electrode arrangement according to the invention can also be used to modify and upgrade the performance of the abovementioned conventional Methods 4 and 5. In the case of Method 4, both described major noise sources external and internal to the machine can be eliminated. The electrode and its connection to said frequency selective sensor can be easily shielded from environmental noise, and carrier short circuits are avoided by the dielectric electrode layer. Further, the sensing of the signals are no longer shunted by the large capacitance between the lapping plates. As a result, Method 4 is upgraded and its frequency limits extended. In addition the method can be extended to automatic lapping control. A suitable arrangement for this is shown in FIG. 7, which is in part analogous to FIG. 4 and where like parts are marked with like reference numerals with a prime (′). The electrode is connected to the input of an impedance matching amplifier 94 whose output is applied to the input of a radio receiver 96. The audio output of the receiver is connected to a level detector 98 whose output is connected to solid state relay 66′ controlling the lapping machine motor 68′. The system can be used as follows. The receiver frequency is adjusted to the desired target frequency and the level detector is adjusted to distinguish between desired signals due to wafer resonance and the smaller undesired noise signals. When the frequency of a wafer under the electrode reaches the target frequency, the level detector 98 triggers solid state relay 66′ to turn off the motor 68′.

In reference to upgrading Method 5, the advantages of using the electrode configuration according to the invention were pointed out before in regard to improved signal/noise ratio, elimination of electrode short circuits and air gap adjustment, and reduction of required signal power. These advantages result in a larger and cleaner signal, simpler signal source, and reduced labor and maintenance.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

I claim:

1. Control apparatus for a machine for lapping wafers, said machine having at least one lapping plate with a lapping surface and at least one piezoelectric wafer, comprising:

a. At least one electrode (able to be inserted) in and isolated from said lapping plate, said electrode being faced with a solid dielectric material with a relative dielectric constant larger than 10 and being positionable toward the lapping surface;

b. means for sensing the resonance frequency of piezoelectric wafers and means for terminating lapping when said resonance frequency reaches a predetermined relationship with a target frequency.

2. Apparatus according to claim 1, wherein said sensing means is operatively connected with said terminating means for terminating lapping automatically.

3. Apparatus according to claim 1, further including means for applying an electrical signal between said electrode and said lapping plate, said signal applying means operatively connected with said sensing means, whereby the resonance frequency is sensed in terms of impedance changes between said electrode and said lapping plate.

4. Apparatus according to claim 3, wherein said sensing means is operatively connected with said terminating means for terminating lapping automatically.

5. Apparatus according to claim 1, wherein said sensing means senses electrical signal changes between said electrode and said lapping plate whereby said resonance frequency is sensed in terms of said signal changes.

6. Apparatus according to claim 5, wherein said sensing means is operatively connected with said terminating means for terminating lapping automatically.

7. Apparatus according to claim 1, wherein said electrode is separated from said lapping plate by an insulator having a relative dielectric constant smaller than 10, a first wall thickness adjacent to the lapping surface, and at least one second wall thickness displaced from the lapping surface, said second wall thickness being larger than the first.

8. Apparatus according to claim 7, wherein said sensing means is operatively connected with said terminating means for terminating lapping automatically.

* * * * *